US012232629B1

(12) United States Patent
Xia

(10) Patent No.: US 12,232,629 B1
(45) Date of Patent: Feb. 25, 2025

(54) FOLDING SWING CHAIR FRAME

(71) Applicant: Lingai Xia, Ningbo (CN)

(72) Inventor: Lingai Xia, Ningbo (CN)

( * ) Notice: Subject to any disclaimer, the term of this patent is extended or adjusted under 35 U.S.C. 154(b) by 0 days.

(21) Appl. No.: 18/921,043

(22) Filed: Oct. 21, 2024

Related U.S. Application Data

(63) Continuation of application No. PCT/CN2024/077676, filed on Feb. 20, 2024.

(30) Foreign Application Priority Data

Apr. 27, 2023 (CN) ..... 202320991551.3

(51) Int. Cl.
*A47C 4/28* (2006.01)
*A47C 3/025* (2006.01)

(52) U.S. Cl.
CPC ..... *A47C 4/286* (2013.01); *A47C 3/0255* (2013.01)

(58) Field of Classification Search
CPC ..... A47C 4/286
See application file for complete search history.

(56) References Cited

U.S. PATENT DOCUMENTS

2023/0165373 A1* 6/2023 Chen ..... A47C 4/286 297/19

FOREIGN PATENT DOCUMENTS

| | | | | |
|---|---|---|---|---|
| CN | 212995495 U | * | 4/2021 | ..... A47C 4/286 |
| CN | 215382619 U | | 1/2022 | |
| CN | 114468677 A | | 5/2022 | |
| CN | 115381238 A | | 11/2022 | |
| CN | 218304086 U | | 1/2023 | |
| CN | 218515440 U | | 2/2023 | |
| CN | 219782035 U | | 10/2023 | |
| DE | 202023101357 U1 | | 3/2023 | |

* cited by examiner

*Primary Examiner* — Anthony D Barfield
(74) *Attorney, Agent, or Firm* — Bayramoglu Law Offices LLC

(57) ABSTRACT

A folding swing chair frame includes two upright tubes connected mutually by a linkage group. The linkage group includes swing rods and at least two crossing tubes, and the crossing tubes are hinged with each other by a crossing point. Upper ends of the crossing tubes are respectively hinged to lower ends of the swing rods, and upper ends of the swing rods are respectively hinged to the upright tubes. The upright tubes are hinged to lower ends of the crossing tubes. Slide sleeve locking pieces are respectively disposed on at least one of the upright tubes and slide along a length direction of the upright tubes. A groove is disposed respectively on the slide sleeve locking pieces. When the frame is unfolded, the slide sleeve locking pieces fall down and the swing rods are sleeved in the grooves to perform locking between the upright tubes and the swing rods.

7 Claims, 8 Drawing Sheets

FOLDING SWING CHAIR FRAME

CROSS REFERENCE TO THE RELATED APPLICATIONS

This application is a continuation application of International Application No. PCT/CN2024/077676, filed on Feb. 20, 2024, which is based upon and claims priority to Chinese Patent Application No. 202320991551.3, filed on Apr. 27, 2023, the entire contents of which are incorporated herein by reference.

TECHNICAL FIELD

The present disclosure relates to the field of chair technologies and in particular to a folding swing chair frame.

BACKGROUND

Along with the continuous improvement of the living levels of modern people, the living pressure and working pressure are also on the increase. More and more people go out for outdoor activities with families and friends to relax their minds and enjoy barbecue in the beautiful days. The folding swing chairs can bring beauty and comfort to the outdoor lives. At present, the swing chairs on the market are usually used after the pins are inserted manually into holes on the tubes. In this case, there may be a problem of instability of the inserted pins. When people sit on the swing chair, the swing chair may be automatically folded up due to gravity, resulting in human injury.

SUMMARY

The object of the present disclosure is to provide a folding swing chair frame, which can improve the supporting stability of the swing chairs.

In order to address the above technical issues, the present disclosure provides the following technical solution: there is provided a folding swing chair frame. The frame includes two upright tubes which are connected mutually by a linkage group. The linkage group includes swing rods and at least two crossing tubes, and the crossing tubes are hinged with each other by a crossing point. Upper ends of the crossing tubes are respectively hinged to lower ends of the swing rods, and upper ends of the swing rods are respectively hinged to the upright tubes. The upright tubes are respectively hinged to lower ends of the crossing tubes. A slide sleeve locking piece is disposed on at least one of the upright tubes. The slide sleeve locking pieces are slid along a length direction of the upright tubes. A groove is disposed respectively on the slide sleeve locking pieces. When the frame is unfolded, the slide sleeve locking pieces fall down and the swing rods are sleeved in the corresponding grooves to perform locking between the upright tubes and the swing rods.

The present disclosure has the following beneficial effects: the slide sleeve locking pieces are slidably connected on the upright tubes; when the frame is unfolded, the slide sleeve locking pieces fall down, the swing rods are sleeved in the corresponding grooves so that the upright tubes and the swing rods can be locked to each other, helping mutual supporting of the upright tubes and the crossing tubes and improving the supporting stability of the swing chair. Meanwhile, it can be avoided that the supporting instability results from insertion of pins by hand and hence causes human injury. In this way, the use safety of the frame can be improved.

Preferably, the slide sleeve locking pieces are sleeve rings in which a through hole is disposed respectively. The upright tubes are inserted through the corresponding through holes. With the above structure, when the upper ends of the swing rods are inserted into the corresponding grooves respectively, the lower ends of the swing rods cannot be rotated around corresponding hinging points between the upper ends of the swing rods and the upright tubes so as to achieve locking between the upright tubes and the swing rods, thus improving the unfolding stability of the frame.

Preferably, steps abutting against the upper ends of the swing rods are disposed in the grooves respectively. With the above structure, the upper ends of the swing rods are stably held inside the grooves, so as to improve the locking stability of the slide sleeve locking pieces on the swing rods.

Preferably, a telescoping tube extending along a length direction of the upright tubes is connected on the upright tubes respectively, and limitation is achieved between the telescoping tubes and the upright tubes by a limiting part. With the above structure, the frame is adjustable in height and easy to fold.

Preferably, the frame further includes support components which are respectively connected at the linkage group. Each of the support components includes foot tubes and support tubes. Lower ends of the foot tubes are supported on the ground and upper ends of the foot tubes are hinged to the swing rod by hinging joints. Ends of the support tubes are hinged to the foot tubes respectively. The other ends of the support tubes are hinged to the crossing tube by a connection foot. With the above structure, the supporting stability of the entire frame can be further improved, helping fold the support components for storage.

Preferably, each of the lower ends of the foot tubes is provided with a foot pad. With the above structure, the supporting stability can be improved.

Preferably, the hinging joints are U-shaped bidirectional hinging sheets. With the above structure, the folding reliability of the foot tubes can be improved.

Figure 1:
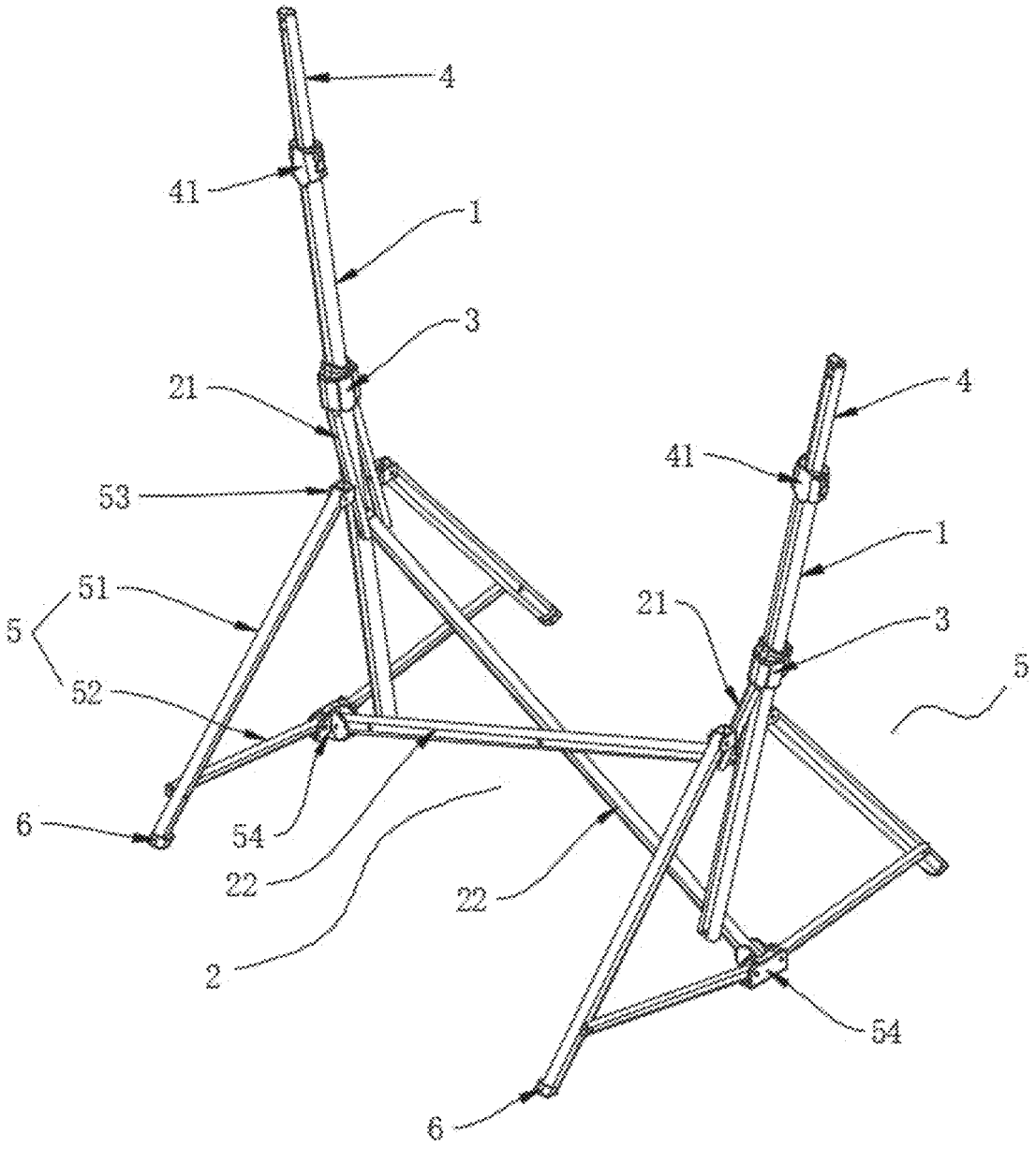
FIG. 1 is a structural schematic diagram illustrating a fully-unfolded folding swing chair frame according to the present disclosure.

Numerals of drawings are described below:

1. upright tube, 2. linkage group, 21. swing rod, 211. bending segment, 22. crossing tube, 3. sleeve ring, 31. through hole, 32. groove, 33. step, 4. telescoping tube,

41. limiting part, 5. support component, 51. foot tube, 52. support tube, 53. hinging joint, 54. connection foot, 6. food pad.

DETAILED DESCRIPTION OF THE EMBODIMENTS

In order to make the above objects, features and advantages of the present disclosure clearer and more intelligible, detailed descriptions will be made below to the specific embodiments of the present disclosure in combination with the drawings.

In the descriptions of the present disclosure, it is to be understood that the orientations or positional relationships indicated by the terms such as upper, lower, front, rear, left and right are based on the orientations or positional relationships shown in the drawings and used only to facilitate descriptions of the present disclosure and simplify the descriptions rather than indicate or imply the indicated device or element must have a specific orientation, or be constructed and operated in a specific orientation, and thus shall not be understood as limiting of the present disclosure.

Figure 2:
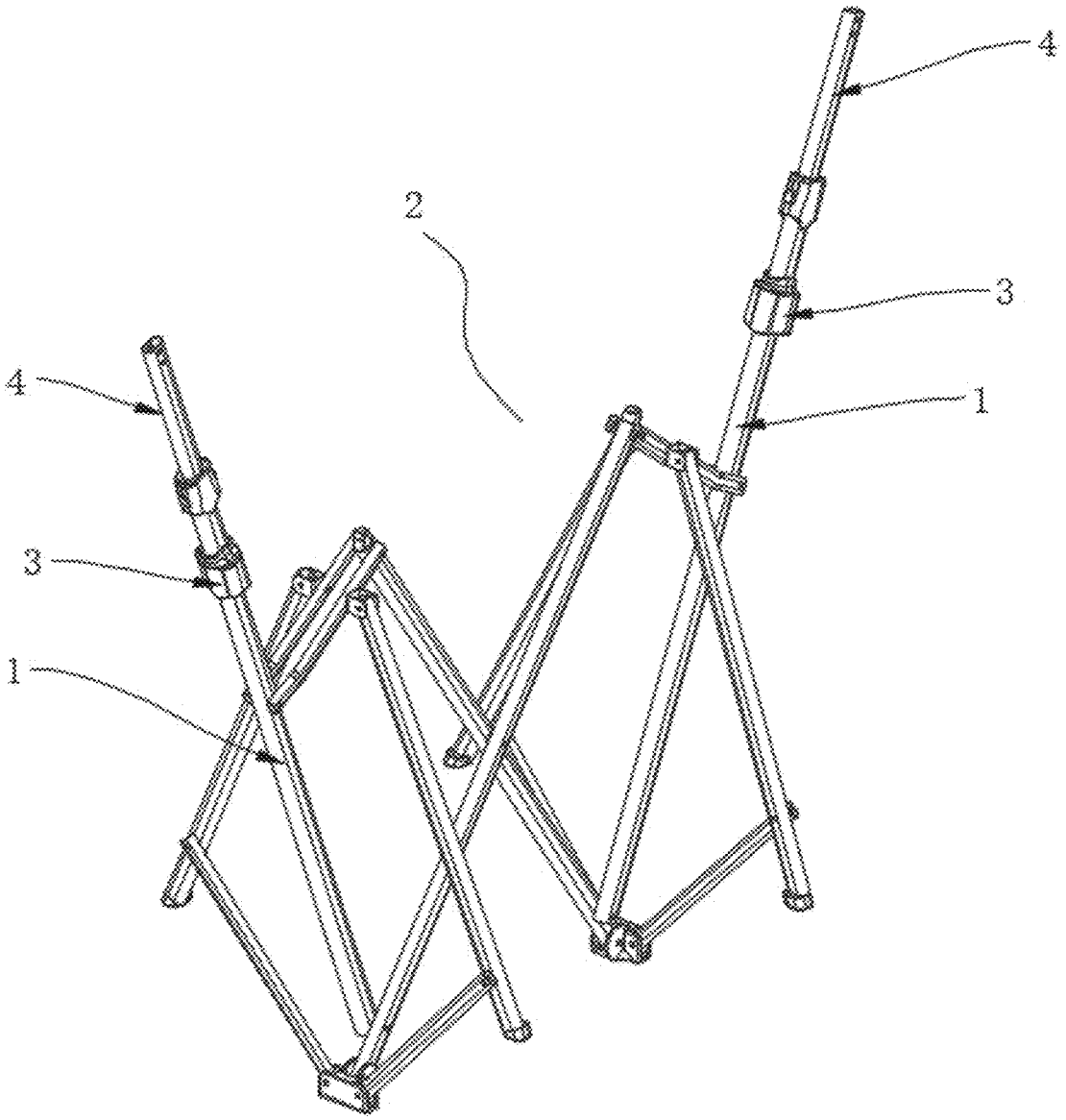
FIG. 2 is a structural schematic diagram illustrating a half-unfolded folding swing chair frame according to the present disclosure.
Figure 3:
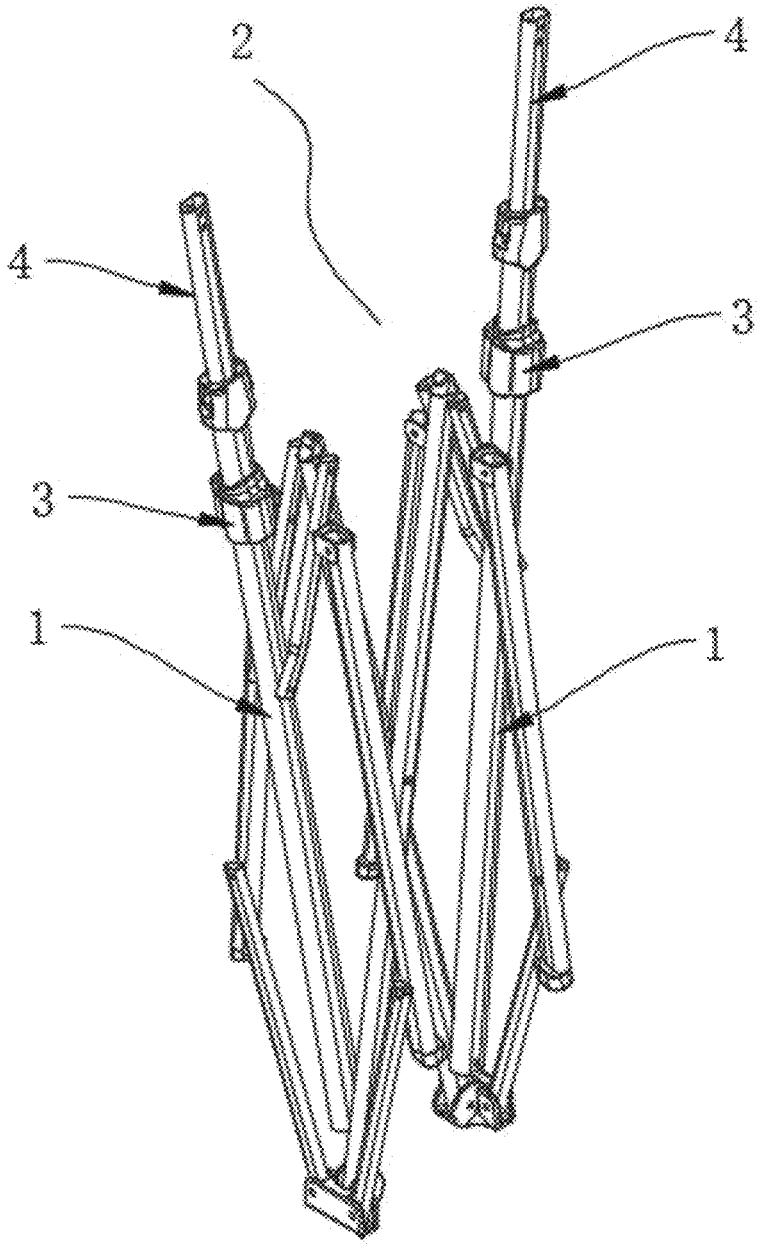
FIG. 3 is a structural schematic diagram illustrating a folded-up folding swing chair frame according to the present disclosure.
Figure 4:
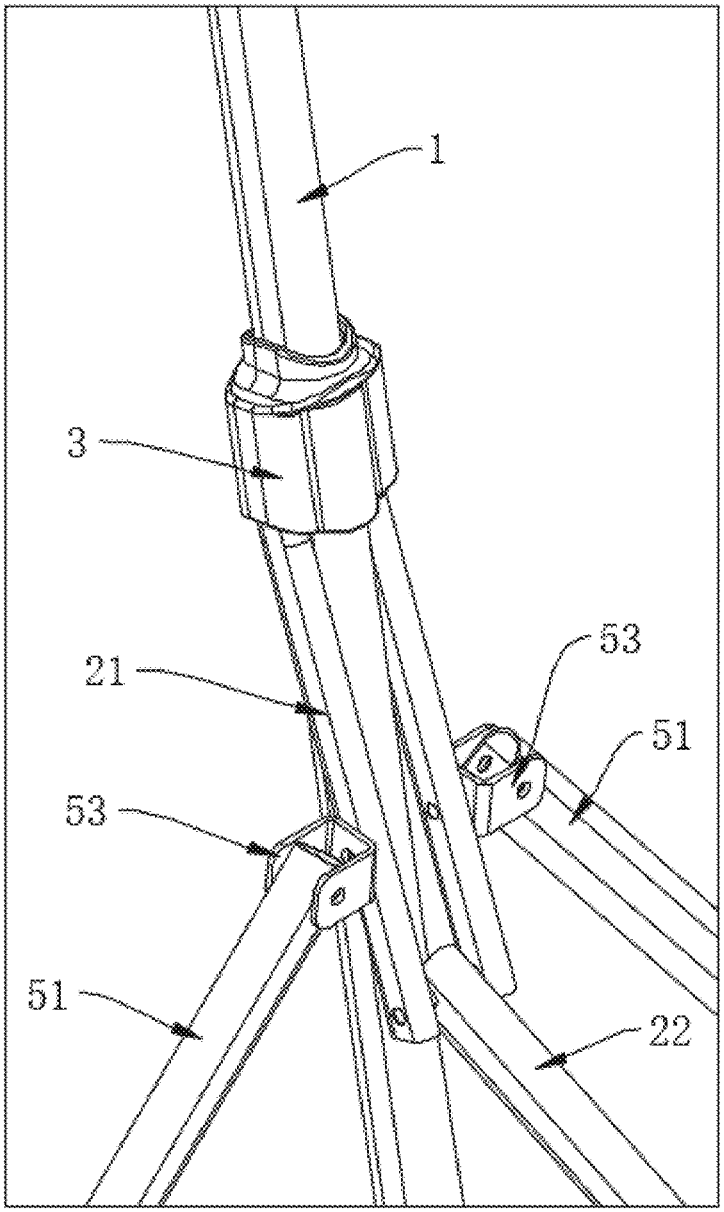
FIG. 4 is a diagram 1 illustrating a working state of a sleeve ring according to the present disclosure.
Figure 5:
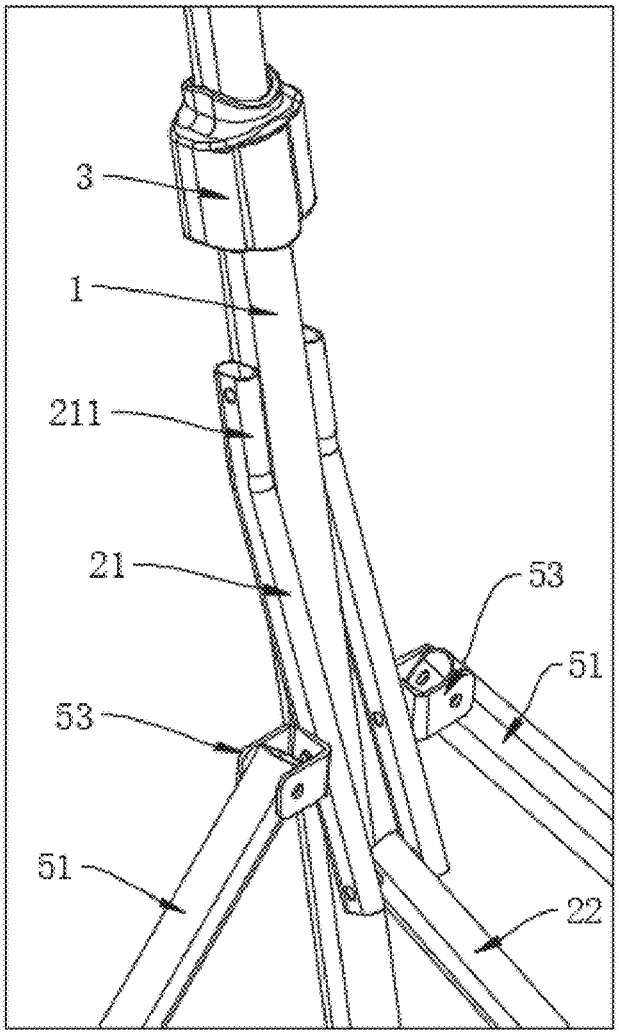
FIG. 5 is a diagram 2 illustrating a working state of a sleeve ring according to the present disclosure.
Figure 6:
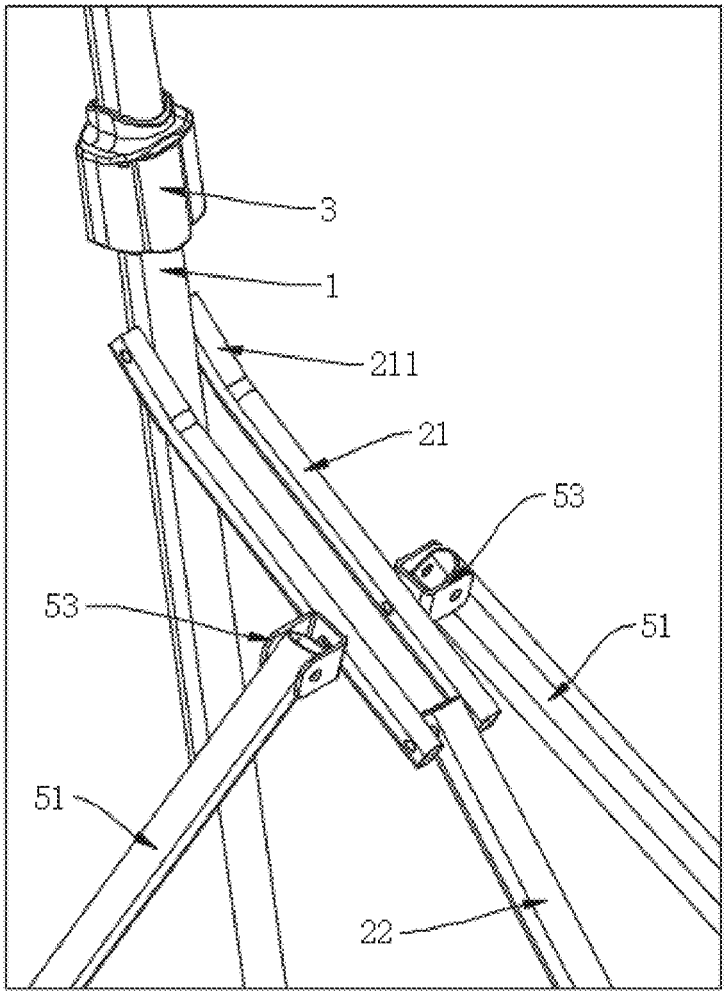
FIG. 6 is a diagram 3 illustrating a working state of a sleeve ring according to the present disclosure.
Figure 7:
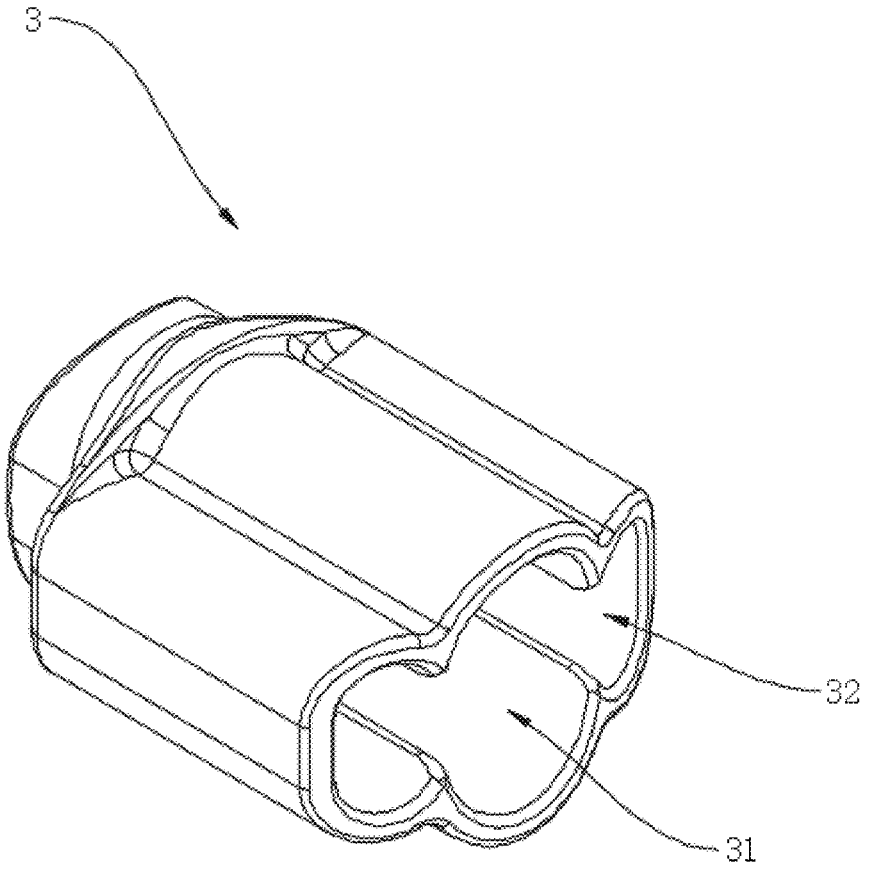
FIG. 7 is a structural schematic diagram illustrating a sleeve ring.
Figure 8:
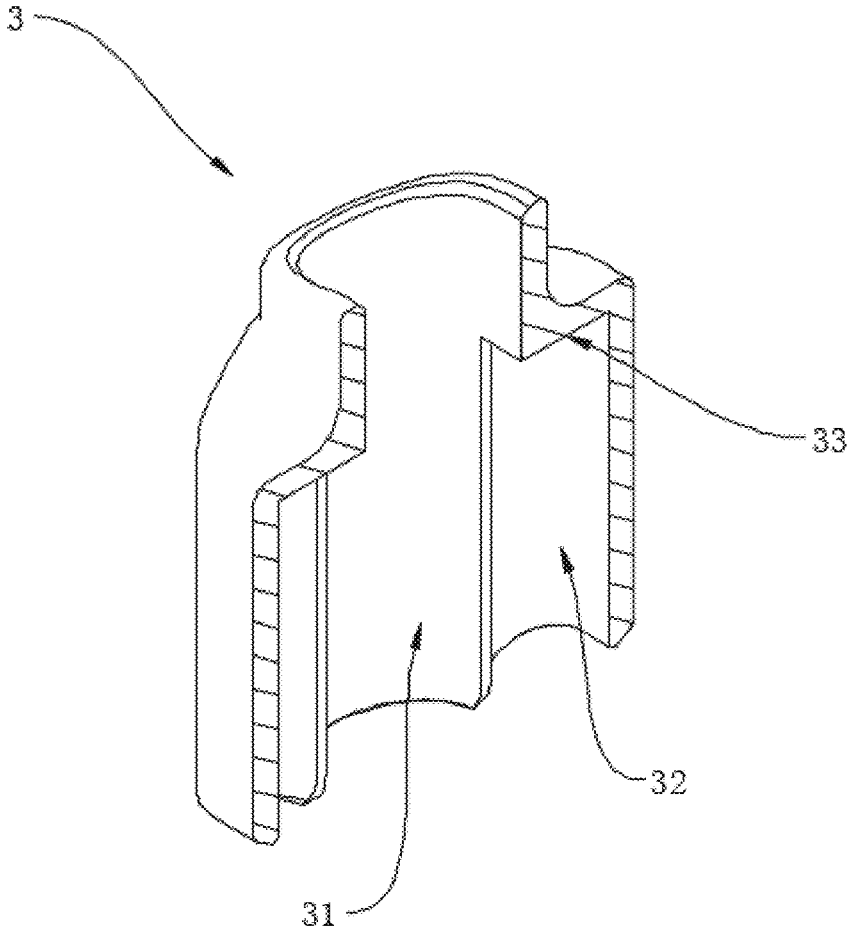
FIG. 8 is a sectional view illustrating a sleeve ring.

As shown in FIGS. 1 to 8, the present disclosure provides a folding swing chair frame. The folding swing chair frame includes two upright tubes 1 disposed at left and right sides, and a linkage group 2 is connected between the two upright tubes 1. The linkage group 2 includes two swing rods 21 and two crossing tubes 22, and the two crossing tubes 22 are hinged with each other by a crossing point. Upper ends of the two crossing tubes 22 are respectively hinged to lower ends of the two swing rods 21, and upper ends of the two swing rods 21 are respectively hinged to the two upright tubes 1. The two upright tubes 1 are respectively hinged to lower ends of the two crossing tubes 22. A slide sleeve locking piece is disposed on the two upright tubes 1 respectively. The slide sleeve locking pieces are slid along a length direction of the upright tubes 1. A groove 32 is disposed on the slide sleeve locking pieces respectively. When the frame is unfolded, the slide sleeve locking pieces fall down and the swing rods 21 are sleeved in the corresponding grooves 32 to perform locking between the upright tubes 1 and the swing rods 21.

In this embodiment, the slide sleeve locking pieces are sleeve rings 3 in which a through hole 31 is disposed respectively. The upright tubes 1 are inserted through the corresponding through holes 31. The grooves 32 are disposed on the sleeve rings 3 respectively, with an opening facing down. When the upper ends of the swing rods 21 are inserted into the corresponding grooves 32 respectively, the lower ends of the swing rods 21 cannot be rotated around corresponding hinging points between the upper ends of the swing rods and the upright tubes 1 so as to achieve locking between the upright tubes 1 and the swing rods 21, thus improving the unfolding stability of the frame. Steps 33 abutting against the upper ends of the swing rods 21 are disposed in the grooves 32 respectively. Therefore, the upper ends of the swing rods 21 can be stably held inside the corresponding grooves 32 so as to improve the locking stability of the slide sleeve locking pieces for the swing rods 21. The upper ends of the swing rods 21 arte bending segments 211. When the bending segments 211 are parallel to the upright tubes 1, the sleeve rings 3 can be sleeved on the corresponding bending segments 211 under the gravity of the sleeve rings 3, thereby increasing the locking and supporting reliability.

In this embodiment, a telescoping tube 4 extending along a length direction of the upright tubes 1 is connected on the upright tubes 1 respectively, and limitation is achieved between the telescoping tubes 4 and the upright tubes 1 by a limiting part 41. In this way, the frame is adjustable in height and easy to fold. The structure of the limiting parts 41 is existing well-known technology and no detailed descriptions are made herein.

In this embodiment, the frame further includes two support components 5 which are respectively connected at both sides of the linkage group 2. Each of the support components 5 includes two foot tubes 51 and two support tubes 52. Lower ends of the two foot tubes 51 are supported on the ground and upper ends of the two foot tubes 51 are hinged to one of the swing rods 21 by two hinging joints 53. Ends of the two support tubes 52 are hinged to the two foot tubes 51 respectively. The other ends of the two support tubes 52 are hinged to one of the crossing tubes 22 by a connection foot 54. In this way, the supporting stability of the entire frame can be further improved, helping fold the support components 5 for storage.

In order to ensure the supporting stability, each of the lower ends of the foot tubes 51 is provided with a foot pad 6 having anti-slip function.

In this embodiment, the hinging joints 53 are U-shaped bidirectional hinging sheets which can improve the folding reliability of the foot tubes 51.

Although the disclosure is made as above, the scope of protection of the present disclosure is not limited hereto. Those skilled in the arts can make various changes and modifications without departing from the spirit and scope of the present disclosure and these changes and modifications shall fall within the scope of protection of the present disclosure.

What is claimed is:

1. A folding swing chair frame, comprising two upright tubes connected mutually by a linkage group, wherein the linkage group comprises swing rods and at least two crossing tubes, and the at least two crossing tubes are hinged with each other by a crossing point; upper ends of the at least two crossing tubes are respectively hinged to lower ends of the swing rods, and upper ends of the swing rods are respectively hinged to the two upright tubes; the two upright tubes are respectively hinged to lower ends of the at least two crossing tubes; slide sleeve locking pieces are respectively disposed on the two upright tubes; the slide sleeve locking pieces are configured to slide along a length direction of the two upright tubes; grooves are disposed respectively on the slide sleeve locking pieces; when the folding swing chair frame is unfolded, the slide sleeve locking pieces fall down, and the swing rods are respectively sleeved in the grooves to perform a locking between the two upright tubes and the swing rods.

2. The folding swing chair frame of claim 1, wherein the slide sleeve locking pieces are sleeve rings, and through holes are disposed in the sleeve rings respectively; the two upright tubes are respectively inserted through the through holes.

3. The folding swing chair frame of claim 2, wherein steps abutting against the upper ends of the swing rods are disposed in the grooves respectively.

4. The folding swing chair frame of claim 1, wherein telescoping tubes extending along the length direction of the two upright tubes are connected on the two upright tubes respectively, and a limitation is achieved between the telescoping tubes and the two upright tubes by a limiting part.

5. The folding swing chair frame of claim 1, further comprising support components, wherein the support components are respectively connected at the linkage group;

each of the support components comprises foot tubes and support tubes; lower ends of the foot tubes are supported on a ground, and upper ends of the foot tubes are hinged to each of the swing rods by a hinging joint; first ends of the support tubes are hinged to the foot tubes, and second ends of the support tubes are hinged to each of the at least two crossing tubes by a connection foot.

6. The folding swing chair frame of claim 5, wherein each of the lower ends of the foot tubes is provided with a foot pad.

7. The folding swing chair frame of claim 5, wherein the hinging joints are U-shaped bidirectional hinging sheets.

* * * * *